US005561856A

United States Patent [19]

Pesco

[11] Patent Number: 5,561,856

[45] Date of Patent: Oct. 8, 1996

[54] PALMAR TYPE ANTERIOR THUMB SUPPORT FOR USE IN A GLOVE AND A GLOVE INCORPORATING THE SAME

[76] Inventor: Mary Pesco, 24 Spring Rd., Huntington, N.Y. 11743

[21] Appl. No.: 293,479

[22] Filed: Aug. 22, 1994

[51] Int. Cl.[6] ..... A41D 13/08; A41D 13/10

[52] U.S. Cl. ..... 2/16; 2/20; 2/21; 2/161.1

[58] Field of Search ..... 2/16, 20, 21, 161.1, 2/161.6, 161.7, 163, 161.5, 160; 602/22, 21

[56] References Cited

U.S. PATENT DOCUMENTS

| | | | |
|---|---|---|---|
| 136,157 | 2/1873 | Hall | 2/21 |
| 4,382,439 | 5/1983 | Shen | 602/22 |
| 4,524,464 | 6/1985 | Primiano et al. | 2/161.1 |
| 4,658,441 | 4/1987 | Smith | 2/161.1 |
| 4,709,694 | 12/1987 | O'Connell | 2/167 |
| 4,840,168 | 6/1989 | Lonardo | 602/22 |
| 4,987,611 | 1/1991 | Maye | 2/20 |
| 5,063,613 | 11/1991 | Brown | 2/21 |
| 5,285,529 | 2/1994 | Arena | 2/16 |
| 5,329,638 | 7/1994 | Hansen et al. | 2/170 |
| 5,345,608 | 9/1994 | Mergens et al. | 2/16 |

FOREIGN PATENT DOCUMENTS

| | | | |
|---|---|---|---|
| 0064432 | 11/1982 | European Pat. Off. | 2/21 |
| 2647314 | 11/1990 | France | 2/21 |

*Primary Examiner*—Amy B. Vanatta
*Attorney, Agent, or Firm*—Galgano & Burke

[57] ABSTRACT

A palmar anterior thumb support for use with a glove or mitten includes a molded thermoplastic insert which extends distal of the wrist on the palmar side of the hand and the thumb. The support covers substantially all of the palm of the hand and substantially all of the palmar side of the thumb. The palm portion of the support is contoured to maintain a correct web space between the thumb and the index finger. The thumb portion of the support is contoured to support the palmar side of the thumb and is provided with two or more upstanding extensions or tabs for laterally supporting the thumb. At least one of the tabs preferably extends partially onto the dorsal side of the hand in the web space between the thumb and the index finger. The palmar support supports not only the thumb, but the CMC, MP, and IP joints and is more comfortable than a dorsal support. The anterior thumb support according to the invention is preferably sewn into the space between fabric layers of a glove and is sized to fit hands of a particular glove size. A glove incorporating the anterior thumb support according to the invention maintains the support in the proper location on the palmar side of the user's hand.

16 Claims, 3 Drawing Sheets

FIG. 6
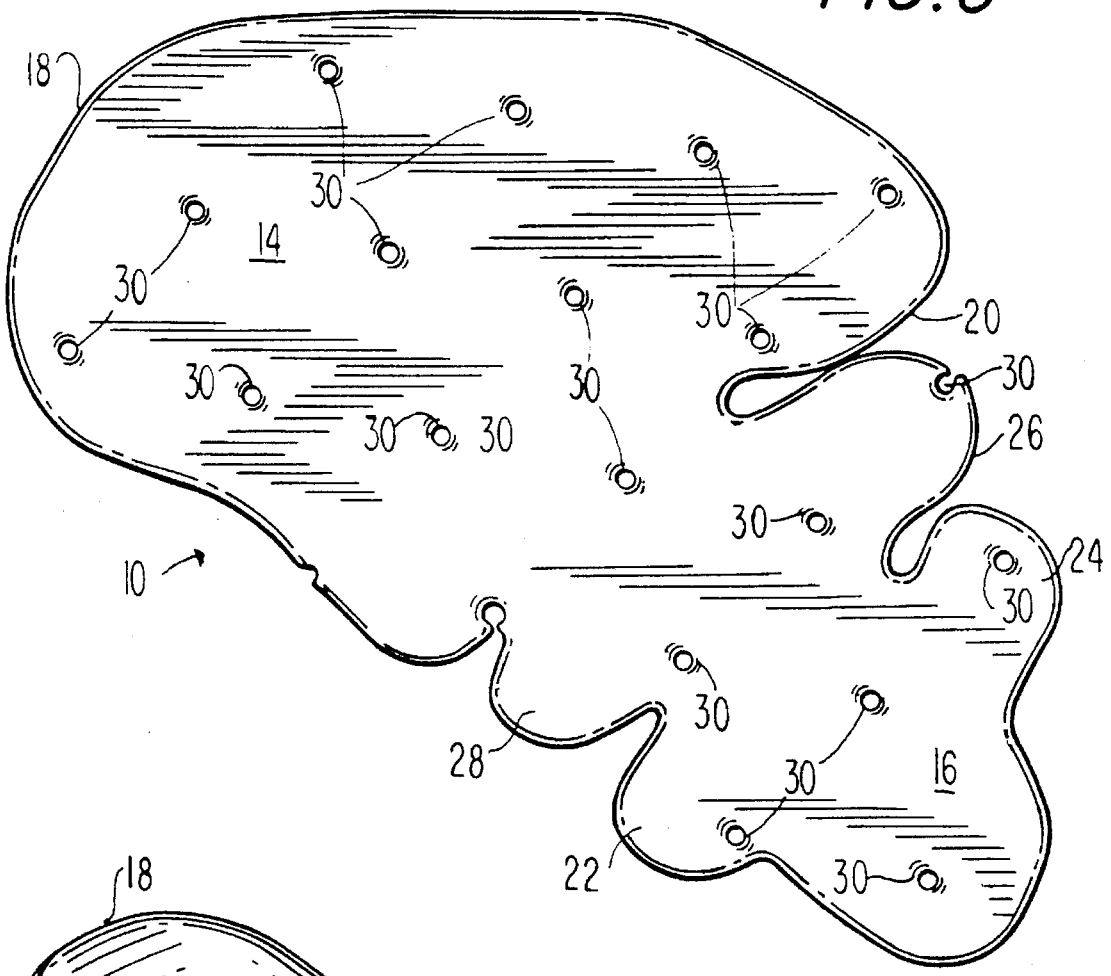
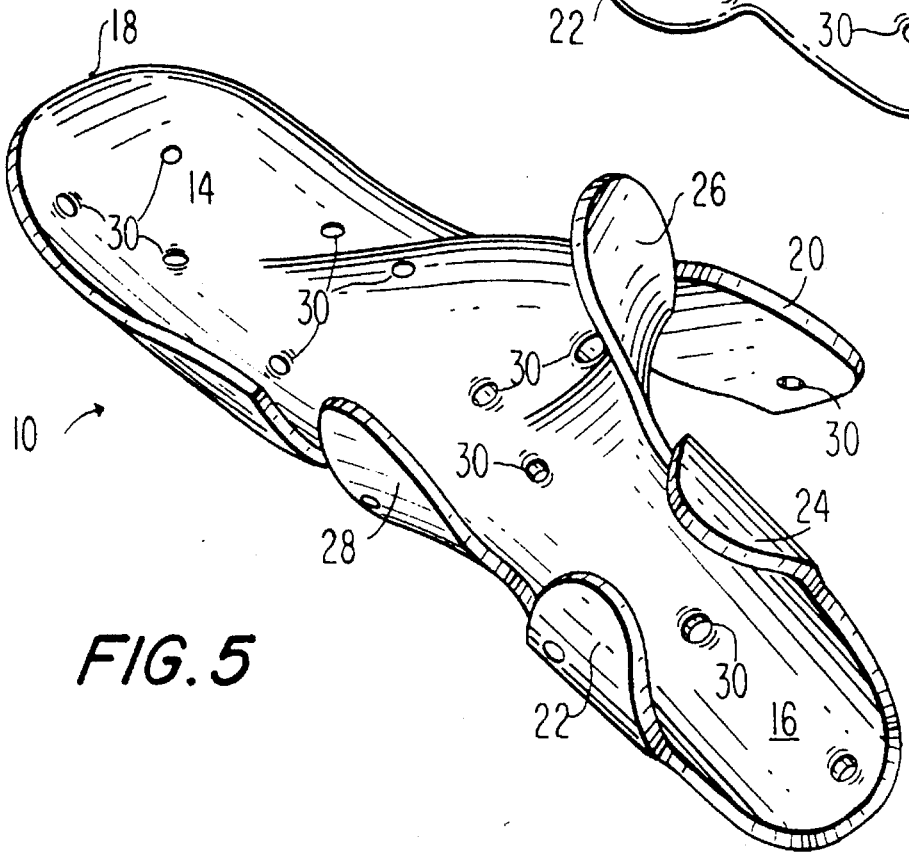
FIG. 5

PALMAR TYPE ANTERIOR THUMB SUPPORT FOR USE IN A GLOVE AND A GLOVE INCORPORATING THE SAME

BACKGROUND OF THE INVENTION

1. Field of the Invention

The invention relates to a thumb support which is incorporated within a glove. More particularly, the invention relates to an anterior or palmar-type thumb support which prevents hyperextension and lateral dislocation of the metacarpophalangeal joint and resultant injury to the ulnar collateral ligament.

2. State of the Art

It is well known that, as a solitary digit, the thumb stands unprotected by immediate adjacent fingers and protrudes from the hand at its metacarpophalangeal (hereinafter "MCP") joint. Hyperextension or lateral dislocation of the MCP joint results in a partial or complete rupture of the ulnar collateral ligament (hereinafter "UCL"). A common mechanism for this type of injury is frequently seen by snow skiers. Snow skiers often sustain an injury to the UCL when their ski pole is fixed and their thumb is suddenly hyperabducted. Also, during a fall, forces are frequently placed on the thumb via the ski pole. The injury so common that it is often called "skier's thumb". Nevertheless, it is not only skier's who are exposed to the risk of this type of thumb injury. Any activity which requires the participant to grasp a pole-like object and/or which risks falling on the hand is subject to producing injury to the UCL. Thus, the injury has also been known as "gamekeeper's thumb" and "breakdancer's thumb". It also often results from "urban cowboy" mechanical bull riding.

The UCL of the thumb MCP joint stabilizes that joint against forces applied in a radial direction to the thumb. When the UCL is damaged, the thumb tends to "run away" from the index finger and the power of pinch is significantly reduced. Treatment of an injury to the UCL often requires complicated microsurgery and it may take eight months to a year before full hand function is recovered. Even in cases of minor injury to the UCL, treatment requires a period of immobilization of the thumb, using a splint, and subsequent physical therapy. It may take twelve to sixteen weeks to recover full use of the thumb.

It is known in the art to provide a glove including a brace to prevent UCL injuries. Primiano et al. U.S. Pat. No. 4,524,464 discloses a safety glove with a modified dorsal thumb spica brace. A pocket within the layers of the glove retains the brace. The brace is a modified dorsal thumb spica beginning distal of the wrist and extending generally to the end of the thumb. The brace extends across the dorsal side of the hand, allowing free movement of the second through fifth digits, and extends on the palmar side distal of the wrist to terminate proximal of the palmar crease. The thumb portion is contoured to resist radial deviation and extension of the thumb, but permit flexion of the MCP and interphalangeal (hereinafter "IP") joints of the thumb towards the fingers.

The dorsal brace is useful in protecting the UCL and MCP joint when a user of the brace attempts to break the force of a fall with an open hand. However, in attempting to provide a brace which does not restrict the use of a ski pole, the dorsal brace allows ski pole pressure to bear directly against the thumb. In addition, the dorsal brace can impinge the metacarpal bone of the thumb, the radial and median nerves, and the surrounding soft tissue of the dorsal aspect of the thumb. With the dorsal brace, the impact and pressure of a ski pole on the thumb is directed to the thumb itself and could fracture or dislocate the IP joint of the thumb.

SUMMARY OF THE INVENTION

It is therefore an object of the invention to provide an anterior thumb support for use within a glove.

It is also an object of the invention to provide an anterior thumb support which will prevent a ski pole from hyperextending the MCP joint of the thumb.

It is another object of the invention to provide an anterior thumb support which allows freedom of finger movement and full grasp of a ski pole while skiing.

It is still another object of the invention to provide an anterior thumb support which is more comfortable than a dorsal thumb brace.

It is also an object of the invention to provide an anterior thumb support which helps protect the thumb from hyperextension in the event of a fall on the hand.

It is another object of the invention to provide an anterior thumb support which will not impinge the metacarpal bone of the thumb, the radial and median nerves, and the surrounding soft tissue of the dorsal aspect of the thumb.

It is still another object of the invention to provide an anterior thumb support which will protect the thumb from impact and pressure of a ski pole.

It is also an object of the invention to provide an anterior thumb support which maintains the correct anatomical functional position of web space between the index finger and the thumb.

It is another object of the invention to provide an anterior thumb support which supports the MCP and the IP joints of the thumb.

It is still another object of the invention to provide an anterior thumb support which supports the carpometacarpal (hereinafter "CMC") joint.

It is also an object of the invention to provide a glove which incorporates an integral anterior thumb support and which maintains the thumb support in an effective position to prevent thumb injury.

In accord with these objects which will be discussed in detail below, the anterior thumb support of the present invention includes a molded thermoplastic insert which extends distal of the wrist on the palmar side of the hand and the thumb. The support covers substantially all of the palm of the hand and substantially all of the palmar side of the thumb. The palm portion of the support is contoured to maintain a correct web space between the thumb and the index finger. The thumb portion of the support is contoured to support the palmar side of the thumb and is provided with two or more upstanding extensions or tabs for laterally supporting the thumb. At least one of the tabs preferably extends partially onto the dorsal side of the hand in the web space between the thumb and the index finger. The anterior support is therefore interposed between the user's thumb and a ski pole or the like and protects the palmar side of the thumb from impact by the ski pole. The support supports not only the thumb, but the CMC, MP, and IP joints and is more comfortable than a dorsal support. The anterior thumb support according to the invention is preferably sewn into the space between fabric layers of a glove and is sized to fit hands of a particular glove size. A glove incorporating the anterior thumb support according to the invention maintains the support in the proper location on the palmar side of the user's hand.

Additional objects and advantages of the invention will become apparent to those skilled in the art upon reference to the detailed description taken in conjunction with the provided figures.

BRIEF DESCRIPTION OF THE DRAWINGS

FIG. 5 is a perspective view of the presently preferred embodiment of the anterior thumb support according to the invention;

FIG. 6 is a plan view of a thermoplastic blank used to form the anterior thumb support according to the invention.

DETAILED DESCRIPTION OF THE PREFERRED EMBODIMENTS

Figure 1:
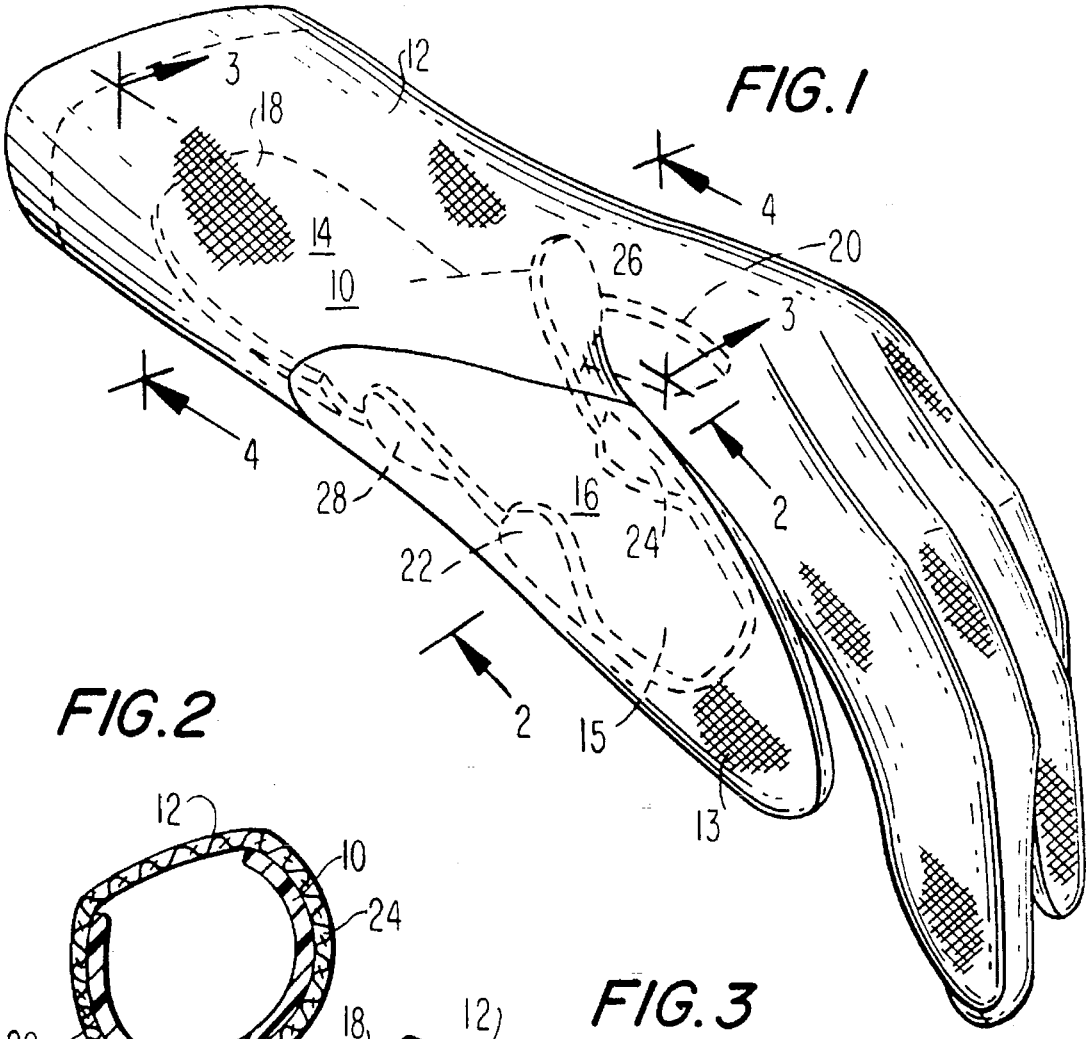
FIG. 1 is a transparent perspective view of a glove incorporating a presently preferred embodiment of the anterior thumb support which is shown in phantom lines.
Figure 2:
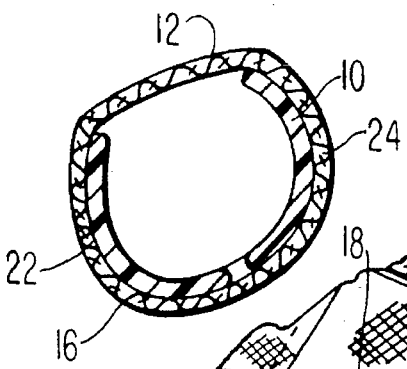
FIG. 2 is a cross sectional view along line 2—2 in FIG. 1.
Figure 3:
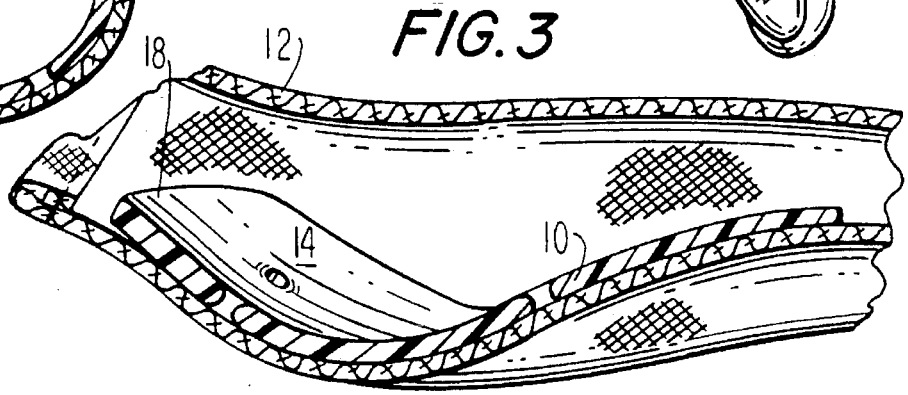
FIG. 3 is a cross sectional view along line 3—3 in FIG. 1.
Figure 4:
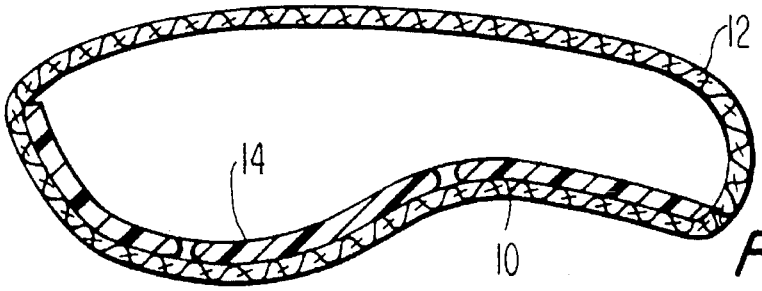
FIG. 4 is a cross sectional view along line 4—4 in FIG. 1.
Figure 7:
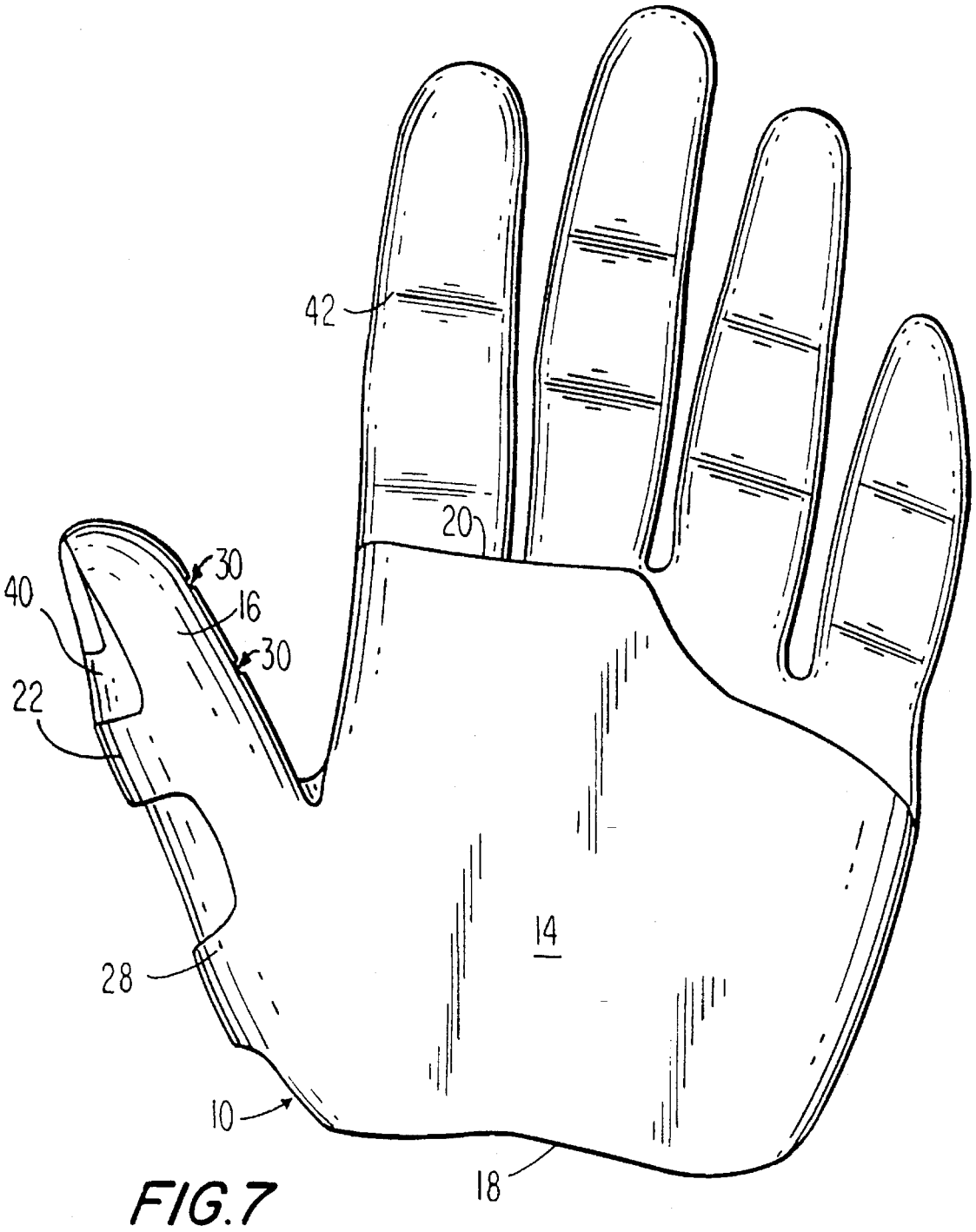
FIG. 7 is a perspective view showing a hand received in the thumb support.

Referring now to FIGS. 1 through 4, the anterior thumb support 10 according to the invention is designed to be used inside a glove 12. The glove 12 is substantially conventional and has one or more fabric layers which extend distally from the wrist and completely cover both the palmar and dorsal sides of the hand and each of the five digits. The support 10 is preferably a substantially rigid molded thermoplastic member having a palm portion 14 and a thumb portion 16. Although the Figures depict a left hand support, it will be appreciated that a "mirror image" right hand support is provided in substantially the same manner as the left hand support. A first edge 18 of the palm portion 14 extends from a point distal of the wrist (not shown) across substantially all of the palm (not shown) to a second edge 20 which lies proximal of the MCP joints of the second through fourth digits (not shown). The second through fifth digits of the hand are thereby unimpeded by the support. As seen best in FIGS. 3, 4 and 7, the palm portion 14 of the support 10 is contoured to fit the palm and maintain correct web space between the thumb 40 and the index finger 42. The thumb portion 16 of the support 10 extends distally from the palm portion 14 on the palmar or anterior side of the thumb 40 (FIG. 7) to substantially the distal end of the thumb 40. As seen best in FIGS. 1, 2 and 7, the thumb portion 16 is provided with at least two upstanding members 22, 24 which curve up around the sides of the thumb 40 for lateral support. According to the presently preferred embodiment, two additional upstanding members 26 and 28 are provided proximal of members 22, 24. Member 26 curves upward into the web space between the thumb and the index finger and member 28 curves upward around the outer side of the thumb 40.

From the foregoing, those skilled in the art will appreciate that the support 10 will support not only the thumb 40, but also the CMC, MP, and IP joints and will protect the thumb from impact pressure by a ski pole or other pole-like object grasped by the hand. It will also be appreciated that while the support 10 prevents palmar and radial displacement of the thumb, the glove thumb 13 offers some protection against dorsal displacement of the thumb because movement of the dorsal side 15 of the glove thumb 13 is also limited by the support 10. Basically, the support is intended to maintain the thumb in a position of safety, i.e., the hand with the thumb positioned parallel to and extending generally below the index finger, in a grasping position. In this position, the thumb opposes and is ready to complete the pinch grip that permits objects (e.g., ski poles), to be grasped. This position allows one to comfortably grasp the ski pole or other similar objects and to perform different activities.

The geometry of the thumb support 10 according to the invention is also seen in FIG. 5 outside of a glove. The thumb support may be inserted into a glove or may be made an integral part of a glove by sewing it into the interior of a glove as seen in FIGS. 1–4 or by sewing it into a space between fabric layers of a glove. As seen best in FIGS. 5 and 6, the support 10 is preferably formed from a stamped-out or die-cut perforate thermoplastic blank having perforations 30 which allow the hand to breathe and aid in sewing the support to the interior of a glove. The blank shown in FIG. 6 is heated and pressed upon a form to mold the contours shown in FIG. 5. Various processes may be employed to mold the blank, including vacuum molding, injection molding, liquid casting, and other methods which will be known to those skilled in the art.

There have been described and illustrated herein a palmar type anterior thumb support for use in a glove and a glove incorporating the support. While particular embodiments of the invention have been described, it is not intended that the invention be limited thereto, as it is intended that the invention be as broad in scope as the art will allow and that the specification be read likewise. Thus, while particular materials have been disclosed, it will be appreciated that other materials could be utilized. Although the support is preferably made of plastic and other high impact resilient plastic splinting materials, any relatively rigid material, including metallic materials, may be used. A soft padding could also be used around the support to provide a more comfortable fit. Also, while a support and a glove have been shown, it will be recognized that support could be used with mitten with similar results obtained. Moreover, while particular configurations have been disclosed in reference to the upstanding members providing lateral thumb support, it will be appreciated that other configurations could be used as well. The dimensions of the support can also be modified and provided for various glove sizes (e.g., large, medium, small, for men, women and children). Furthermore, while the blank for forming the support has been disclosed as having perforations, it will be understood that perforations may be added after the blank is formed or may be omitted entirely. It will therefore be appreciated by those skilled in the art that yet other modifications could be made to the provided invention without deviating from its spirit and scope as so claimed.

What is claimed is:

1. A thumb support for use inside a glove or mitten for engagement with the palmar side of the human hand to prevent hyperextension and lateral dislocation of the metacarpophalangeal joint, said support member comprising:

a substantially rigid insert having a palm portion and a thumb portion for maintaining a functionally correct web space between a thumb and an index finger, said palm portion having contour and dimensions such that it extends under substantially all of the palm, said palm portion having a first edge which lies adjacent to the wrist and a second edge which lies adjacent to the base of the fingers, and said thumb portion having a contour and being dimensioned such that it extends under substantially all of the palmar side of the thumb.

2. A thumb support according to claim 1, wherein:

said substantially rigid insert includes at least two upstanding portions on either side of the thumb.

3. A thumb support according to claim 1, wherein:

said substantially rigid insert includes at least one upstanding portion in the web space between the thumb and the index finger.

4. A thumb support according to claim 1, wherein:

said substantially rigid insert covers substantially none of the dorsal side of the hand.

5. A thumb support according to claim 3, wherein:

said at least one upstanding portion extends onto the dorsal side of the hand between the thumb and the index finger.

6. A thumb support according to claim 1, wherein:

said substantially rigid insert is molded thermoplastic.

7. A thumb support according to claim 1, wherein:

said substantially rigid insert is perforated.

8. A thumb support according to claim 1, wherein:

said substantially rigid insert supports the thumb, the CMC, the MCP, and the IP joints.

9. A reinforced glove adapted to fit over the human hand for preventing hyperextension and lateral dislocation of the metacarpophalangeal joint, said glove comprising:

a) one or more outer fabric layers extending distally from the wrist and covering both the palmar and dorsal sides of the hand and each of the five digits;

b) a substantially rigid insert disposed between the palmar side of the hand and one of said one or more outer fabric layers, said substantially rigid insert having a palm portion and a thumb portion for maintaining a functionally correct web space between a thumb and an index finger, said palm portion having contour and dimensions such that it extends under substantially all of the palm, said palm portion having a first edge, which lies adjacent to the wrist and a second edge which lies adjacent to the base of the fingers, said thumb portion having a contour and being dimensioned such that it extends under substantially all of the palmar side of the thumb.

10. A reinforced glove according to claim 9, wherein:

said substantially rigid insert includes at least two upstanding portions on either side of the thumb.

11. A reinforced glove according to claim 9, wherein:

said substantially rigid insert includes at least one upstanding portion in the web space between the thumb and the index finger.

12. A reinforced glove according to claim 9, wherein:

said substantially rigid insert covers substantially none of the dorsal side of the hand.

13. A reinforced glove according to claim 11, wherein:

said at least one upstanding portion extends onto the dorsal side of the hand between the thumb and the index finger.

14. A reinforced glove according to claim 9, wherein:

said substantially rigid insert is molded thermoplastic.

15. A reinforced glove according to claim 9, wherein:

said substantially rigid insert is perforated.

16. A reinforced glove according to claim 9, wherein:

said substantially rigid insert supports the thumb, the CMC, the MCP, and the IP joints.

* * * * *